United States Patent [19]

McLaughlin et al.

[11] Patent Number: 4,923,577

[45] Date of Patent: May 8, 1990

[54] ELECTROCHEMICAL-METALLOTHERMIC REDUCTION OF ZIRCONIUM IN MOLTEN SALT SOLUTIONS

[75] Inventors: David F. McLaughlin, Oakmont; Francis Talko, North Huntingdon Twp., Westmoreland County, both of Pa.

[73] Assignee: Westinghouse Electric Corp., Pittsburgh, Pa.

[21] Appl. No.: 242,564

[22] Filed: Sep. 12, 1988

[51] Int. Cl.[5] ..... C25C 3/26

[52] U.S. Cl. ..... 204/64 T; 203/51; 423/73; 423/76; 423/492; 75/617; 75/618

[58] Field of Search ..... 204/64 T; 203/51; 423/73, 76, 492

[56] References Cited

U.S. PATENT DOCUMENTS

| | | | |
|---|---|---|---|
| 1,582,860 | 4/1926 | van Arkel | 423/73 |
| 2,214,211 | 9/1940 | Von Zeppelin | 75/84.5 |
| 2,816,814 | 12/1957 | Plucknett | 203/71 |
| 2,852,446 | 9/1958 | Bromberg | 203/1 |
| 2,905,613 | 9/1959 | Tomonari | 204/216 |
| 2,920,027 | 1/1960 | Dean | 204/218 |
| 2,938,769 | 5/1960 | Overholser | 423/70 |
| 2,942,969 | 6/1960 | Doyle | 75/84.5 |
| 2,951,021 | 8/1960 | DiPietro | 204/64 T |
| 3,006,719 | 10/1961 | Miller | 423/70 |
| 3,764,493 | 10/1973 | Nicks | 204/64 R |
| 3,966,458 | 6/1976 | Spink | 75/84.5 |
| 3,966,460 | 6/1976 | Spink | 75/84.4 |
| 4,021,531 | 4/1977 | Besson | 423/492 |
| 4,127,409 | 11/1978 | Megy | 75/84.4 |
| 4,285,724 | 8/1981 | Becker | 75/84.4 |
| 4,511,399 | 4/1985 | Kwon | 75/84.5 |
| 4,556,420 | 12/1985 | Evans | 75/84.5 |
| 4,613,366 | 9/1986 | Kwon | 75/84.5 |
| 4,637,831 | 1/1987 | Stoltz | 75/84.5 |
| 4,668,287 | 5/1987 | Kwon | 75/84.5 |
| 4,670,121 | 6/1987 | Ginatta | 204/225 |
| 4,737,244 | 4/1988 | McLaughlin | 203/51 |
| 4,749,448 | 6/1988 | Stoltz | 203/51 |

FOREIGN PATENT DOCUMENTS 625938 8/1961 Canada .

OTHER PUBLICATIONS

Martinez et al.; Metall. Trans., 3,571, 1972.
Mellors et al.; J. Electrochem. Soc., 114,60, 1966.

*Primary Examiner*—T. Tung
*Assistant Examiner*—David G. Ryser
*Attorney, Agent, or Firm*—R. A. Stoltz

[57] ABSTRACT

This is a method of reducing zirconium chloride to a metal product by introducing zirconium chloride into a molten salt bath containing at least one alkali metal chloride and at least one alkaline earth metal chloride; and electrochemically reducing alkaline earth metal chloride to a metallic alkaline earth metal in the molten salt bath, with the reduced alkaline earth metal reacting with the zirconium chloride to produce zirconium metal. By using this electrochemical-metallothermic reduction, zirconium metal is produced and insoluble subchlorides of zirconium in the metal product are generally avoided.

Preferably, the molten salt in the molten salt bath consists essentially of a mixture of lithium chloride, potassium chloride, magnesium chloride and zirconium or hafnium chloride. The method is especially useful as part of a distillation system for separating hafnium from zirconium, possibly after the zirconium chloride is removed from the distillation system, but especially where the distillation system has an alkali metal chloride and alkaline earth metal chloride recirculating solvent and the electrochemical-metallothermic reduction is used to strip the solvent of zirconium chloride.

This process can also be used for hafnium and titanium, especially when a powder metal product is desired.

4 Claims, 3 Drawing Sheets

ELECTROCHEMICAL-METALLOTHERMIC REDUCTION OF ZIRCONIUM IN MOLTEN SALT SOLUTIONS

CROSS-REFERENCE TO RELATED APPLICATIONS

A process for zirconium-hafnium separation is described in related application Ser. No. 242,574, filed 9-12-88 (and now allowed) and assigned to the same assignee. That related application utilizes a complex of zirconium-hafnium chlorides (as used herein, unless otherwise indicated, the chlorides of zirconium and hafnium are the tetrachlorides), and phosphorus oxychloride prepared from zirconium-hafnium chloride with the complex of zirconium-hafnium chloride and phosphorus oxychloride being introduced into a distillation column and a hafnium chloride enriched stream is taken from the top of the column and a zirconium enriched chloride stream is taken from the bottom of the column, and in particular with prepurifying said zirconium-hafnium chlorides prior to introduction of the complex into a distillation column to substantially eliminate iron chloride from the zirconiumhafnium chloride, whereby buildup of iron chloride in the distillation column is substantially eliminated and the column can be operated in a continuous stable manner.

A process for zirconium-hafnium separation is described in related application Ser. No. 242,571, filed 9-12-88 (and now allowed) and assigned to the same assignee. That related application utilizes a complex of zirconium-hafnium chloride and phosphorus oxychloride introduced into a distillation column, with a hafnium chloride enriched stream of complex taken from the top of the column and a zirconium-enriched chloride stream of complex taken from the bottom of the column, followed by reduction of the zirconium or hafnium chloride from complex taken from the distillation column by electrochemically bringing zirconium or hafnium out of a molten salt bath, with the molten salt in the molten salt bath consisting principally of a mixture of alkali metal and alkaline earth metal chlorides and zirconium or hafnium chloride.

A process for zirconium-hafnium separation is described in related application Ser. No. 242,570, filed 9-12-88 (and now allowed) and assigned to the same assignee. That related application utilizes an extractive distillation column with a mixture of zirconium and hafnium tetrachlorides introduced into a distillation column and a molten salt solvent circulated through the column to provide a liquid phase, and with the molten salt solvent consisting principally of lithium chloride and at least one of sodium, magnesium and calcium chlorides. Stripping of the zirconium chloride taken from the bottom of distillation column is provided by electrochemically reducing zirconium from the molten salt solvent. A pressurized reflux condenser is used on the top of the column to add zirconium-hafnium chloride to the previously stripped molten salt solvent which is being circulated back to the top of the column.

An improved process for prepurification of zirconium-hafnium chlorides prior to preparation of a complex of zirconium-hafnium chlorides and phosphorus oxychloride for use in a distillation column for zirconium-hafnium separation is described in related application Ser. No. 242,572, filed 9-12-88 (and now allowed) and assigned to the same assignee. That related application utilizes prepurification of zirconiumhafnium chlorides prior to complexing with phosphorus oxychloride by passing the zirconium-hafnium chloride through an essentially oxygen-free molten salt purification-sublimation system, and at least periodically removing iron chloride from the molten salt purification-sublimation system by electrochemically plating iron out of molten salt purification-sublimation system. The molten salt in the molten salt purification-sublimation system consisting essentially of a mixture of alkali metal and alkaline earth metal chlorides, zirconium-hafnium chlorides and impurities.

A process for separating nickel from zirconium for recycling nickel-containing zirconium alloy is described in related application Ser. No. 242,573, filed 9-12-88 (and now allowed) and assigned to the same assignee. That related application utilizes placing nickel-containing zirconium metal in a molten salt bath with the molten salt in the molten salt bath consisting principally of a mixture of at least two alkali metal fluorides to produce a molten salt bath containing dissolved zirconium, electrochemically plating the nickel from the molten salt bath at a voltage sufficient to plate nickel but less than the voltage to plate zirconium to provide an essentially nickel-free molten salt bath; and then electrochemically reducing the zirconium from the essentially nickel-free molten salt bath to provide an essentially nickel-free zirconium.

A process for removing phosphorus oxychloride from a complex of zirconium or hafnium chloride and phosphorus oxychloride is described in related application Ser. No. 242,563, filed 9-12-88 (and now allowed) and assigned to the same assignee. That related application utilizes an alkali metal chloride molten salt absorber vessel with a condenser which has the complex of zirconium or hafnium chloride and phosphorus oxychloride as the condensing fluid to scrub zirconium or hafnium chloride from the phosphorous oxychloride vapor. The process uses at least one separate vessel to strip the zirconium or hafnium chloride from the alkali metal chloride molten salt.

BACKGROUND OF THE INVENTION

This invention relates to reduction of zirconium or hafnium chloride after (or in combination with) separation of hafnium from zirconium and in particular relates to electrochemically-metallothermically reducing zirconium or hafnium in a molten salt bath.

Molten (fused) salt electrochemical (electrolytic) processes for deposition of metal on one electrode (with evolution of chlorine gas at the other electrode) are known in the art. U.S. Pat. No. 3,764,493 to Nicks et al., and U.S. Pat. No. 4,670,121 to Ginatta et al. are examples of such processes.

Naturally occurring zirconium ores generally contain from 1 to 3 percent hafnium oxide relative to zirconium oxide. In order that the zirconium metal be acceptable as a nuclear reactor material, the hafnium content must first be reduced to low levels, due to the high neutron absorption cross section of hafnium. This separation process is difficult due to the extreme chemical similarity of the two elements. A number of techniques have been explored to accomplish this separation, with the technique currently in use in the United States involving liquid-liquid extraction of aqueous zirconyl chloride thiocyanate complex solution using methyl isobutyl ketone, generally as described in U.S. Pat. No. 2,938,769, issued to Overholser on May 31, 1960, with the removal of iron impurities prior to solvent extraction generally as described in U.S. Pat. No. 3,006,719, issued to Miller on Oct. 31, 1961.

Several other processes have been suggested for separation of the zirconium-hafnium tetrachloride $(Zr,Hf)Cl_4$ generated from the ore by carbochlorination. U.S. Pat. No. 2,852,446, issued to Bromberg on Sept. 16, 1958, describes a high pressure distillation process where the pressure, rather than a solvent, provides for a liquid phase. U.S. Pat. No. 2,816,814 issued to Plucknett on Dec. 17, 1957, describes extractive distillation for separation of the tetrachlorides using a stannous chloride solvent. U.S. Pat. No. 4,021,531 issued to Besson on Apr. 3, 1977, utilizes extractive distillation with an alkali metal chloride and aluminum (or iron) chloride mixture as the solvent. Processes for zirconium-hafnium separation are described in U.S. Pat. Nos. 4,737,244, 4,749,448 issued to McLaughlin et al. and to Stoltz et al., provide for zirconium-hafnium separation by extractive distillation with the molten solvent containing zinc chloride and a viscosity reducer. Another separation process involves fractionation of the chemical complex formed by the reaction of $(Zr,Hf)Cl_4$ with phosphorus oxychloride ($POCl_3$). This technique was patented in 1926 by van Arkel and de Boer (U.S. Pat. No. 1,582,860), and was based on the approximately 5° C. boiling point difference between the hafnium and zirconium complex pseudoazeotropes, having the nominal compositions $(Zr,Hf)Cl_4.(2/3)POCl_3$. Despite an extensive investment in time and money, the liquid-liquid extraction described in the above-mentioned U.S. Pat. No. 2,938,769 of Overholser remains the only commercially utilized process for zirconium-hafnium separation in the United States today.

Zirconium, hafnium and titanium are commonly reduced from the chloride by means of a reducing metal such as magnesium or sodium. At the present time the commercial processes are batch-type processes. U.S. Pat. No. 3,966,460, for example, describes a process of introducing zirconium tetrachloride vapor onto molten magnesium, with the zirconium being reduced and traveling through the magnesium layer to the bottom of the reactor and with the by-product magnesium chloride being periodically removed.

In commercial processes, a portion of the by-product salt (e.g. magnesium chloride) is removed manually after the batch has been completed and cooled, and the remainder of the salt and the remaining excess reducing metal is removed in a distillation or leaching process.

Modifications to the reduction process have been suggested in many U.S. Patents, including U.S. Pat. Nos. 4,511,399, 4,556,420, 4,613,366, 4,637,831, and 4,668,287, assigned to the same assignee. A high temperature process using zirconium tetrachloride as a part of a molten salt bath in which zirconium is reduced from the chloride to the metal (molten salt systems mentioned were potassium-zirconium chlorides and sodium-zirconium chlorides) is suggested in U.S. Pat. No. 2,214,211 to Von Zeppelin et al. A relatively high temperature process using zirconium tetrachloride as a part of a molten salt bath and introducing magnesium to reduce zirconium from the chloride to the metal (with external electrolytic reduction of magnesium from the chloride to the metal, to recycle magnesium) is suggested in U.S. Pat. No. 4,285,724 to Becker et al. Another high temperature process using zirconium tetrachloride as a part of a molten salt bath and which introduces sodium-magnesium alloy to reduce zirconium from the chloride to the metal (with a molten salt of magnesium chloride and sodium chloride) is suggested in U.S. Pat. No. 2,942,969 to Doyle. Using zirconium tetrachloride as a part of a molten salt bath and preferably introducing aluminum (but possibly magnesium) to reduce zirconium from the chloride to the metal, generally with the aluminum being introduced dissolved in molten zinc is taught by Megy in U.S. Pat. No. 4,127,409. Electrolytic-refining (metal in, metal out purification, rather than reduction from the chloride) processes are suggested in U.S. Pat. Nos. 2,905,613 and 2,920,027.

Direct electrolysis of zirconium has been reported in all-chloride molten salt systems, in mixed chloride-fluoride systems, and in all fluoride systems (Martinez et al, Metallurgical Transactions, Vol. 3, Feb. 1972–571; Mellors et al, J. of the Electrochemical Soc., Jan. 1966-60). All-metallic deposits were obtained from fluoride-containing baths (e.g. at 800° C. using sodium fluorozirconate), but the efforts to plate out of all-chloride baths always produced a significant amount of subchlorides.

SUMMARY OF THE INVENTION

This is a method of reducing zirconium chloride in an all-chloride bath to a metal product by introducing zirconium chloride into a molten salt bath (to produce a molten salt mixture consisting principally of at least one alkali metal, generally magnesium or calcium, chloride and at least one alkaline earth metal chloride, and chloride of zirconium or hafnium), and electrochemically reducing alkaline earth metal chloride (e.g. magnesium chloride) to a metallic alkaline earth metal (e.g. magnesium) in the molten salt bath, with the reduced alkaline earth metal reacting with the zirconium chloride to produce zirconium metal and alkaline earth metal chloride, whereby zirconium metal is produced and insoluble subchlorides of zirconium in the metal product are generally avoided.

Preferably, the molten salt in the molten salt bath consists essentially of a mixture of lithium chloride, potassium chloride, magnesium chloride and zirconium chloride, and preferably with the relative proportions of the chlorides of lithium and potassium in near-eutectic proportions (about 59 mole percent lithium chloride and about 41 mole percent potassium chloride). The bath can be operated at 360°–500° C.

The method is especially useful as part of a system for separating hafnium from zirconium of the type wherein a feed containing zirconium and hafnium chlorides is introduced into a distillation column, a hafnium chloride enriched stream is taken from the top of the column, and a zirconium enriched chloride stream is taken from the bottom of the column. The reduction to metal of the zirconium or hafnium chloride taken from the distillation column is then by electrochemically reducing an alkaline earth metal in a molten salt bath with the reduced alkaline earth metal reacting with the zirconium or hafnium chloride to produce zirconium metal and alkaline earth metal chloride. The combination of separating hafnium from zirconium and then reducing the zirconium to metal is especially useful in conjunction with the aforementioned Ser. No. 242,570 as the electrochemicalmetallothermic reduction of this invention can be used directly as the stripper in that distillation system as the same molten salt can be used in both.

While not required to avoid subchlorides of hafnium or titanium, electrochemical-metallothermic reduction can also be used to make powdered metallic hafnium or titanium.

BRIEF DESCRIPTION OF THE DRAWINGS

The invention may be better understood by reference to the drawings, in which.

As noted above, the production of zirconium and hafnium metal is conventionally accomplished by chlorination of the ore to produce mixed zirconium-hafnium tetrachloride, $(Zr,Hf)Cl_4$. For nuclear grade applications, the hafnium must be removed from the zirconium to lower its neutron absorption cross-section. This is commonly done by solvent extraction, in which the tetrachloride is first dissolved in water to form an oxychloride solution, and then contacted with an organic phase in a series of solvent extraction columns, with the result that the zirconium and hafnium streams are partitioned. The oxychloride solutions are then precipitated and calcined to oxides before rechlorination to the tetrachloride form. Production of zirconium metal is done by the Kroll reduction process, which entails mixing the zirconium tetrachloride with magnesium metal in a sealed reduction furnace and heating to high temperatures of about 850° C. The following metallothermic reaction then takes place:

$$ZrCl_4 + 2\ Mg \rightarrow Zr + 2\ MgCl_2, \quad (1)$$

with the evolution of heat.

The zirconium is formed as a fine, granular, crystalline material, embedded in a matrix of metallic magnesium zirconium alloy with occluded $MgCl_2$. The magnesium chloride and unreacted magnesium are separated from the zirconium first by physically removing much of the $MgCl_2$ and then by heating until the Mg and remaining $MgCl_2$ are removed by distillation. During the distillation process, the divided zirconium sinters into a denser form, known as "sponge," having a significantly lower specific surface area than the original reduction deposit. As a result of this lower surface area, the sponge may be exposed to air without picking up excessive amounts of oxygen by surface oxidation; this is important in that oxygen tends to make the final metal brittle and unworkable, such that oxygen levels less than 1000 ppm may be desired in the final product (in some products, much less being desired).

The overall Kroll reduction process is highly labor intensive, due to the batch nature of the process and the requirement of welding to hermetically seal the charge within the reduction furnace and of later removing it by cutting the vessel open. There is also significant cost associated with various disposable liners and other components, as well as the heating requirements. Since its initial development, Kroll reduction has frustrated efforts to convert the process to a continuous basis. Additional costs include the cost of magnesium metal, and handling and disposal of the byproduct $MgCl_2$. It is therefore the objective of the present invention to teach an alternative configuration for reduction of $ZrCl_4$ to zirconium metal, in which significantly lower temperatures are required, chemical costs and undesirable byproduct generation are both minimized, and the process is simplified to reduce labor costs and permit the possibility of continuous processing.

Figure 1:
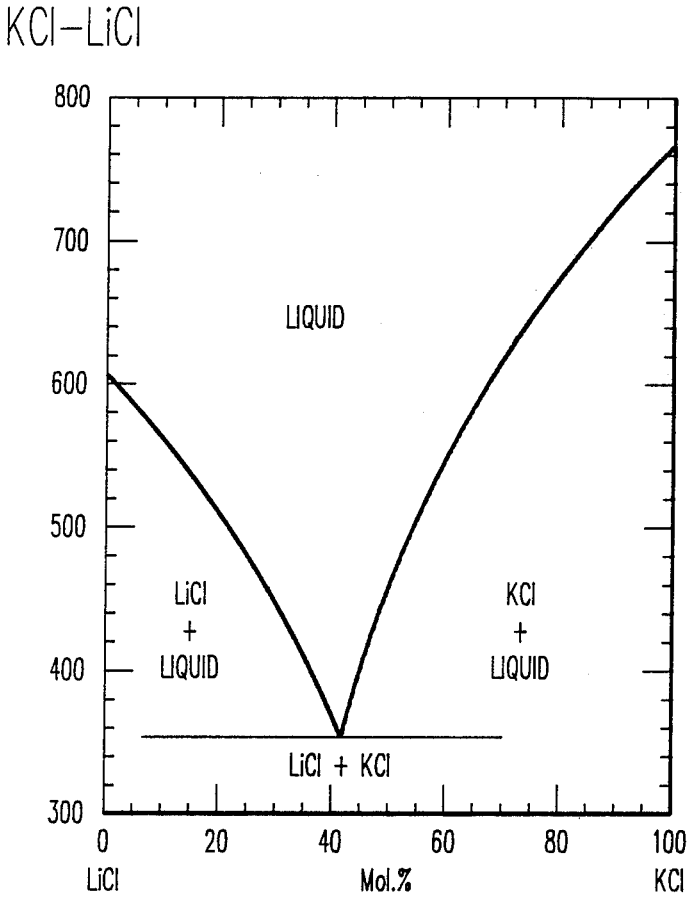
FIG. 1 is a phase diagram of the LiCl-KCl system.

According to the present invention, electrolytic-metallothermic reduction of $ZrCl_4$ to zirconium metal may be done in the solution phase, using as a solvent a molten alkali metal chloride salt or salt mixture. A variety of possible solvents are possible, including LiCl, KCl, NaCl, and mixtures thereof, with the preferred solvent having a KCl to LiCl ratio of the eutectic mixture of 59 mole percent LiCl, 41 mole percent KCl. The phase diagram of the LiCl-KCl system is shown in FIG. 1. This mixture exhibits a melting point of 361° C., can be studied readily at temperatures between 400° and 450° C. in Pyrex vessels, and is well understood, with a considerable body of data existing on electrochemical potentials for various reactions; the electromotive force series for this solvent at 450° C. is shown in Table 1 (excerpts from the Carson table from Planbook, J. Chem. Eng. Data, 12, 77, 1967, Bard, A. J., *Encyclopedia of Electrochemistry of the Elements*, Marcel Dekkar, 1976). Zirconium tetrachloride exhibits a good solubility in this melt, becoming bound in the solution phase as the potassium hexachlorozirconate ($K_2ZrCl_6$) complex, which is stable at these temperatures and exhibits little vapor pressure of $ZrCl_4$. The low liquidus temperature of this solvent is therefore critical to the success of the process, in that it inhibits evaporation of $ZrCl_4$, permitting high solvent loadings without the need to operate the system above atmospheric pressure.

TABLE 1

Summary of the Electromotive Force Series - 450° C.

| Couple | E°(Pt), V M | E°(Pt), V m | E°(Pt), V x | E°(Ag), V m | Precision, V |
|---|---|---|---|---|---|
| Li(I)/Li(O) | −3.304 | −3.320 | −3.410 | −2.593 | 0.002 |
| Na(I)/Na(O) | −3.25 | −3.23 | −3.14 | −2.50 | 0.008 |
| $H_2$(g),Fe/H | −2.80 | −2.98 | −3.11 | −2.25 | 0.06 |
| Ce(III)/Ce(O) | −2.905 | −2.910 | −2.940 | −2.183 | 0.03 |
| La(III)/La(O) | −2.848 | −2.853 | −2.883 | −2.126 | 0.007* |
| Y(III)/Y(O) | −2.831 | −2.836 | −2.866 | −2.109 | 0.008 |
| Nd(III)/Nd(O) | −2.819 | −2.824 | −2.854 | −2.097 | 0.005* |
| Gd(III)/Gd(O) | −2.788 | −2.793 | −2.823 | −2.066 | 0.005* |
| Mg(II)/Mg(O) | −2.580 | −2.580 | −2.580 | −1.853 | 0.002 |
| Sc(III)/Sc(O) | −2.553 | −2.558 | −2.588 | −1.831 | 0.015 |
| Th(IV)/Th(O) | −2.350 | −2.358 | −2.403 | −1.531 | 0.005*, *** |
| U(III)/U(O) | −2.218 | −2.223 | −2.253 | −1.496 | 0.005** |
| Be(II)/Be(O) | −2.039 | −2.039 | −2.039 | −1.312 | 0.013 |
| Np(III)/Np(O) | −2.033 | −2.038 | −2.068 | −1.311 | 0.005*** |
| U(IV)/U(O) | −1.950 | −1.957 | −2.002 | −1.230 | 0.011** |
| Zr(IV)/Zr(II) | −1.864 | −1.880 | −1.970 | −1.153 | −.01** |
| Mn(II)/Mn(O) | −1.849 | −1.849 | −1.849 | −1.122 | 0.008 |
| Hf(IV)/Hf(O) | −1.827 | −1.835 | −1.880 | −1.108 | 0.01 |

TABLE 1-continued

Summary of the Electromotive Force Series - 450° C.

| Couple | E°(Pt), V M | E°(Pt), V m | E°(Pt), V x | E°(Ag), V m | Precision, V |
|---|---|---|---|---|---|
| Np(IV)/Np(O) | −1.817 | −1.825 | −1.870 | −1.098 | 0.004**, *** |
| Zr(IV)/Zr(O) | −1.807 | −1.815 | −1.860 | −1.088 | 0.01 |
| Al(III)/Al(O) | −1.762 | −7.767 | −1.797 | −1.040 | 0.009 |
| Zr(II)/Zr(O) | −1.75 | −1.75 | −1.75 | −1.02 | 0.01* |
| Ti(II)/Ti(O) | −1.74 | −1.74 | −1.74 | −1.01 | 0.01 |
| Sm(III)/Sm(II) | −1.713 | −1.729 | −1.819 | −1.002 | 0.006 |
| Pu(III)/Pu(O) | −1.698 | −1.703 | −1.733 | −0.976 | 0.002 |
| Ti(III)/Ti(O) | −1.60 | −1.61 | −1.64 | −0.88 | 0.02** |
| Am(III)/Am(O) | −1.588 | −1.593 | −1.623 | −0.866 | 0.002 |
| Zn(II)/Zn(O) | −1.566 | −1.566 | −1.566 | −0.839 | 0.002 |
| V(II)/V(O) | −1.533 | −1.533 | −1.533 | −0.806 | 0.01 |
| Ti(IV)/Ti(O) | −1.486 | −1.494 | −1.539 | −0.767 | 0.05*** |
| Cm(III)/Cm(O) | −1.470 | −1.475 | −1.505 | −0.748 | 0.005 |
| Tl(I)/Tl(O) | −1.465 | −1.449 | −1.359 | −0.722 | 0.002 |
| Cr(II)/Cr(O) | −1.425 | −1.425 | −1.425 | −0.698 | 0.003 |
| Yb(III)/Yb(II) | −1.359 | −1.375 | −1.465 | −0.648 | 0.003 |
| Ti(III)/Ti(II) | −1.32 | −1.34 | −1.43 | −0.61 | 0.02 |
| Cd(II)/Cd(O) | −1.316 | −1.316 | −1.316 | −0.589 | 0.002 |
| V(III)/V(O) | −1.217 | −1.277 | −1.307 | −0.550 | 0.01** |
| In(I)/In(O) | −1.210 | −1.194 | −1.104 | −0.467 | 0.012 |
| Pu(IV)/Pu(O) | −1.199 | −1.208 | −1.650 | −0.634 | 0.006** |
| Np(IV)/Np(III) | −1.170 | −1.186 | −1.276 | −0.459 | 0.002*** |
| Fe(II)/Fe(O) | −1.172 | −1.172 | −1.172 | −0.445 | 0.005 |
| Se(1),C/$Se_x^{2-}$ | −1.141 | −1.172 | −1.252 | −0.445 | 0.002* |
| Nb(III?)/Nb(O) | −1.15 | −1.16 | −1.19 | −0.43 | 0.1*** |
| U(IV)/U(III) | −1.144 | −1.160 | −1.250 | −0.433 | 0.01 |
| Ga(III)/Ga(O) | −1.136 | −1.141 | −1.171 | −0.414 | 0.008 |
| Cr(III)/Cr(O) | −1.125 | −1.130 | −1.160 | −0.403 | 0.01** |
| Pb(II)/Pb(O) | −1.101 | −1.101 | −1.101 | −0.374 | 0.002 |
| Sn(II)/Sn(O) | −1.082 | −1.082 | −1.082 | −0.355 | 0.002 |
| S(1),C/$S_x^{2-}$ | −1.008 | −1.039 | −1.219 | −0.312 | 0.002* |
| In(III)/In(O) | −1.033 | −1.038 | −1.068 | −0.311 | 0.009** |
| Co(II)/Co(O) | −0.991 | −0.991 | −0.991 | −0.264 | 0.003 |
| Ta(IV)/Ta(O) | −0.957 | −0.965 | −1.010 | −0.238 | 0.01*** |
| In(III)//In(I) | −0.944 | −0.960 | −1.050 | −0.233 | 0.005 |
| Cu(I)/Cu(O) | −0.957 | −0.941 | −0.851 | −0.214 | 0.004 |
| Ni(II)/Ni(O) | −0.795 | −0.795 | −0.795 | −0.068 | 0.002 |
| Ge(II)/Ge(O) | −0.792 | −0.792 | −0.792 | −0.065 | 0.008 |
| V(III)/V(II) | −0.748 | −0.764 | −0.854 | −0.037 | 0.002 |
| Fe(III)/Fe(O) | −0.753 | −0.758 | −0.788 | −0.031 | 0.006** |
| Ag(I)/Ag(O) | −0.743 | −0.727 | −0.637 | 0.000 | 0.002 |
| Ge(IV)/Ge(O) | −0.728 | −0.736 | −0.781 | −0.009 | 0.008** |
| Sn(IV)/Sn(O) | −0.694 | −0.702 | −0.747 | +0.025 | 0.003** |
| HC1(g)/$H_2$(g), Pt | −0.694 | −0.710 | −0.800 | +0.017 | 0.005 |
| Ge(IV)/Ge(II) | −0.665 | −0.681 | −0.771 | +0.046 | −0.002 |
| Sb(III)/Sb(O) | −0.635 | −0.640 | −0.670 | +0.087 | 0.002 |
| Bi(III)/Bi(O) | −0.635 | −0.640 | −0.670 | +0.087 | 0.01 |
| Hg(II)/Hg(O) | −0.622 | −0.622 | −0.622 | +0.105 | |
| Mo(III)/Mo(O) | −0.603 | −0.608 | −0.638 | +0.119 | 0.002* |
| W(II)/W(O) | −0.585 | −0.585 | −0.585 | +0.142 | 0.015 |
| Eu(III)/Eu(II) | −0.538 | −0.554 | −0.644 | +0.173 | 0.007 |
| Cr(III)/Cr(II) | −0.525 | −0.541 | −0.631 | +0.186 | 0.01 |
| As(III)/As(O) | −0.460 | −0.465 | −0.495 | +0.262 | 0.017 |
| Cu(II)/Cu(O) | −0.448 | −0.448 | −0.448 | +0.279 | 0.003** |
| Tl(III)/Tl(O) | −0.385 | −0.390 | −0.420 | +0.377 | 0.003** |
| Re(IV)/Re(O) | −0.325 | −0.333 | −0.389 | +0.394 | 0.005 |
| Sn(IV)/Sn(II) | −0.310 | −0.326 | −0.416 | +0.416 | 0.003 |
| $UO_2^2 \not\leftrightarrow UO_2$ | −0.285 | −0.285 | −0.285 | +0.442 | 0.005 |
| $I_2$(g)/C/$I^-$ | −0.207 | −0.254 | −0.525 | +0.473 | 0.008 |
| Pd(II)/Pd(O) | −0.214 | −0.214 | −0.214 | +0.513 | 0.002 |
| Rh(III)/Rh(O) | −0.196 | −0.201 | −0.231 | +0.526 | 0.004 |
| Ru(III)/Ru(O) | −0.107 | −0.112 | −0.142 | +0.615 | 0.007 |
| Te(II)/Te(O) | −0.10 | −0.10 | −0.10 | +0.63 | 0.03 |
| Ir(III)/Ir(O) | −0.057 | −0.062 | −0.092 | +0.665 | 0.002 |
| Pt(II)/Pt(O) | 0.000 | 0.000 | 0.000 | +0.727 | 0.002 |
| Cu(II)/Cu(I) | +0.061 | +0.045 | −0.045 | +0.772 | 0.002 |
| Fe(III)/Fe(II) | +0.086 | +0.070 | −0.020 | +0.797 | 0.003 |
| $NpO_2^+$/NpO | +0.072 | +0.088 | +0.198 | +0.815 | 0.002* |
| $NpO_2^{2+}$/$NpO_2^+$ | +0.102 | +0.086 | −0.004 | +0.723 | 0.020* |
| Pt(IV)/Pt(II) | +0.142 | +0.126 | +0.036 | +0.763 | 0.010 |
| Tl(III)/Tl(I) | +0.155 | +0.139 | +0.049 | +0.866 | 0.002 |
| $Br_2$(g),C/$Br^-$ | +0.177 | +0.130 | −0.141 | +0.857 | 0.002 |
| Au(I)/Au(O) | +0.205 | +0.221 | +0.311 | +0.948 | 0.008 |
| Pu(IV)/Pu(III) | +0.298 | +0.282 | +0.192 | +1.025 | 0.006 |

TABLE 1-continued

| Couple | Summary of the Electromotive Force Series - 450° C. E°(Pt), V M | E°(Pt), V m | E°(Pt), V x | E°(Ag), V m | Precision, V |
|---|---|---|---|---|---|
| $Cl_2(g),C/Cl^-$ | +0.322 | +0.306 | +0.216 | +1.033 | 0.002 |

*Extrapolated
**Calculated
***Precision estimated by writer

Introduction of zirconium tetrachloride into the solvent may be done in a number of ways. $ZrCl_4$ vapor may be bubbled into the molten salt, added as a solid (either powdered or as pellets), or introduced as a molten complex. An alternative technology for zirconium-hafnium separation involves distillation of the complexes of $(Zr,Hf)Cl_4$ with $POCl_3$; in this case, the feed to the reduction process would be the distillation complex $ZrCl_4.(2/3)POCl_3$. The LiCl-KCl solvent is capable of accepting this distillation complex directly, in that the following complex displacement reaction will occur:

$$ZrCl_4.(2/3)POCl_3(l)+2\ KCl(l)\rightarrow K_2ZrCl_6(l)+2/3\ POCl_3(g), \quad (2)$$

with recovery of the evolved phosphorus oxychloride easily accomplished by condensation of the vapor. The resulting potassium hexachlorozirconate solution is then ready for reduction.

Note that reduction of zirconium in this solvent requires that the solvent be dry and free of oxygen. This may be accomplished by a number of techniques, including bubbling of HCl or $Cl_2$ through the melt. The preferred technique is electrolysis of the melt with an aluminum cathode and graphite anode. This will electrolyze any moisture or hydroxyl ions in the melt, with the endpoint being readily recognized by an increase in circuit voltage to 3.3 volts, indicating electroplating of lithium metal onto the aluminum electrode, and chlorine evolution at the graphite electrode. Because of its sensitivity to corrosion, the aluminum electrode is removed from the system before addition of $ZrCl_4$.

Figure 2:
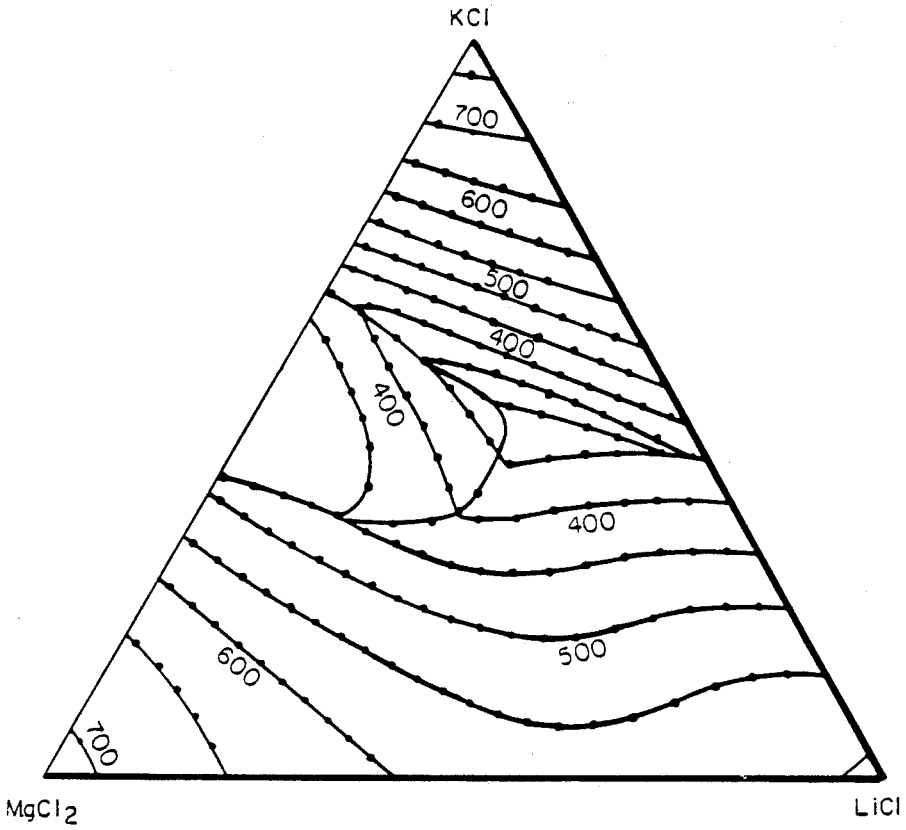
FIG. 2 is a phase diagram of the ternary LiCl-KCl-$MgCl_2$ system.

Direct metallothermic reduction of the solutionphase $ZrCl_4$ can be accomplished by contacting the solution with metallic magnesium. Because of the potential difference between Mg(II)/Mg(O) and Zr(IV)/Zr(O), the driving force is sufficient to cause an almost immediate exchange of magnesium metal and zirconium ions, according to Equation (1), with magnesium going into solution as $MgCl_2$. The solubility of $MgCl_2$ in this system is considerable, as seen in the ternary phase diagram in FIG. 2. The magnesium content could therefore increase to nearly 30 mole percent of the total before the liquidus temperature had increased to 450° C. Precipitation of solid magnesium chloride would therefore provide an endpoint, limiting the amount of zirconium which could be reduced (note that the presence of $MgCl_2$ may destabilize the $ZrCl_4$-KCl complex, with attendant increase in the $ZrCl_4$ vapor pressure and sublimation lesses; this process might also impose an endpoint). Metallic zirconium powder collects at the bottom of the cell.

However, the magnesium chloride may be continuously electrolyzed by application of a current between the source of magnesium and an appropriate anode (graphite being an obvious candidate). With a current applied to this electrode pair, the voltage drop will be equal to 2.90 volts, the difference between the Mg(II)/Mg(O) and $Cl/Cl_2$ voltages (see Table 1), with chlorine evolved at the (positive) graphite electrode, and magnesium regenerated inside the cell, e.g. redeposited on the (negative) magnesium electrode so that exposure of magnesium to air and the resulting oxygen pickup is avoided. In this way, with sufficient current applied to balance the number of chemical equivalents of $ZrCl_4$ being reduced, all of the metallothermically oxidized magnesium may be continuously regenerated electrolytically, and thus the amounts of magnesium and magnesium chloride can be maintained essentially constant, and all of the chloride associated with the $ZrCl_4$ may be eliminated from the system as gaseous $Cl_2$, available for recycle to the crude chlorination process. During operation the magnesium is apparently partly as metal and partly as chloride. The initial charge of magnesium can be added as metal, as chloride or both.

In one experiment, in which the phosphorus oxychloride complex of $ZrCl_4$ was added to molten LiCl-KCl eutectic at 460° C., using magnesium and graphite electrodes with a 100 mA current passing between them, an immediate reduction in electrode potential was observed, from the initial lithium potential of 3.3 volts down to the magnesium potential of 2.9 volts, indicating rapid dissolution of Mg(II) and its electrolytic redeposition on the cathode. At no point did the voltage drop to the zirconium potential of 2.1 volts, which would indicate faradaic reduction of zirconium. Nevertheless, all of the zirconium was recovered as a metallic powder from the bottom of the electrolysis cell, at a point in the experiment when less than half the coulombs had been supplied as required to completely reduce the zirconium feed electrolytically. The form of the deposit was granular, crystalline, (not highly pyrophoric), zirconium metal, very similar in appearance to the product of Kroll reduction prior to distillation (if the magnesium matrix of the Kroll reduction is etched away), and the product of this invention will, after distillation, be generally similar to Kroll product after distillation. A similar experiment with hafnium chloride feed produced some metallic deposit on the cathode and some metallic powder at the bottom of the cell. The amount of hafnium product which is in the powder form can be varied by controlling temperature end current density in the cell. Titanium powder can apparently also be made electro- chemically-metallothermically. When a powdered zirconium, hafnium or titanium product is desired, the distillation step is not performed (and a leaching step, for example, substituted).

Figure 3:
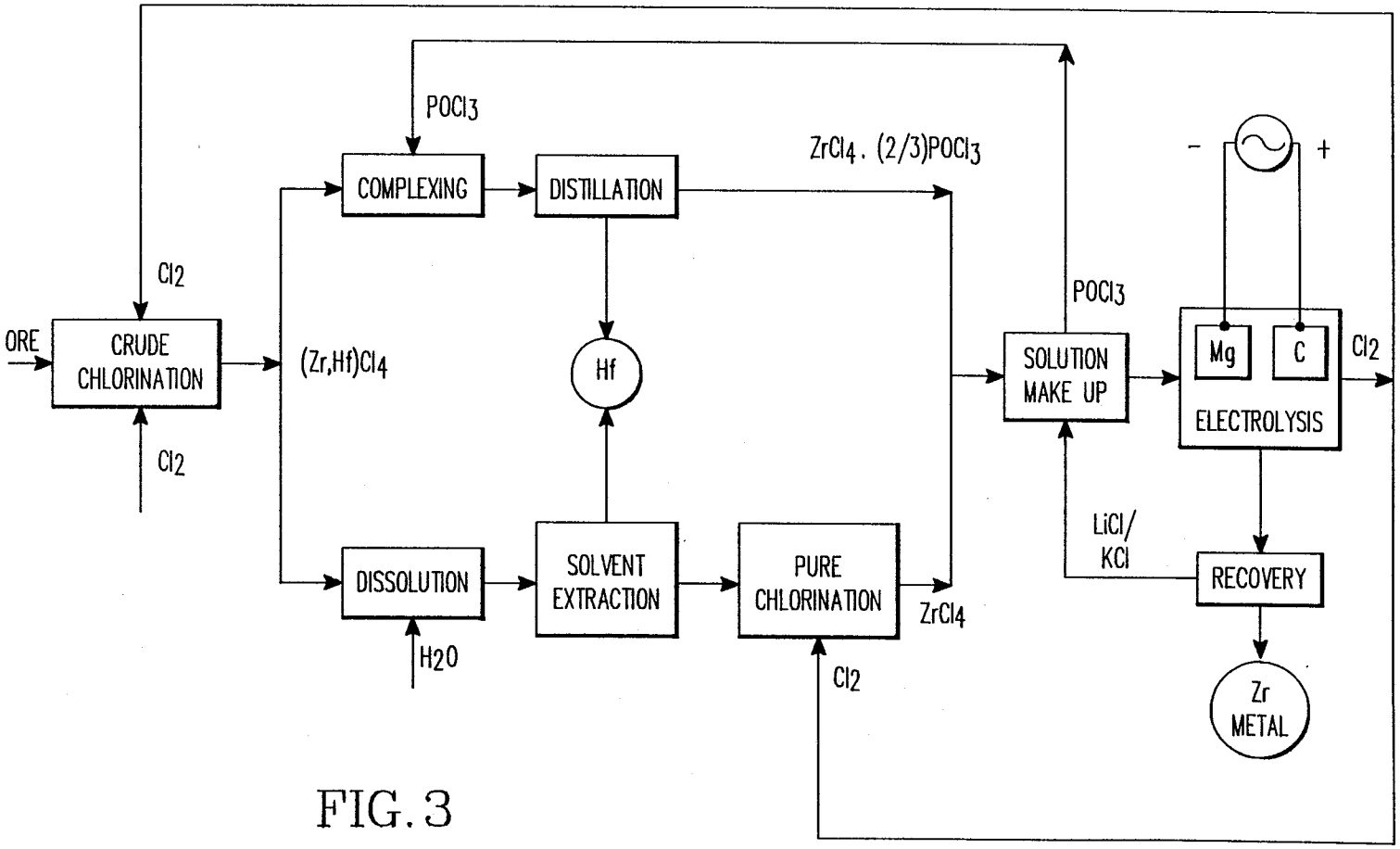
FIG. 3 is a flow diagram of zirconium production using molten salt solution-phase metallothermic reduction.

An overall flow diagram for this process is shown in FIG. 3, illustrating how solution-phase reduction may be incorporated in either a traditional solvent extraction separations plant, or a molten salt $POCl_3$ complex distillation separations plant. In this way, consumable reagents ($Cl_2$, and $POCl_3$) can be fully recycled internally within the facility, and the principal input to drive the reduction is electrical energy. Since the principal cost of magnesium metal consumed by traditional Kroll reduction is that of the electrical energy required to produce it initially from $MgCl_2$, the cost of solution-phase reduction should be generally less than the magnesium cost in traditional Kroll reduction. Considerable overall cost savings are therefore to be expected, since recycle of the chlorine eliminates or greatly reduces this reagent cost, and there is no waste/by-product magnesium chloride stream to be disposed of. In addition, this process lends itself to continuous operation, reducing the labor and materials costs associated with traditional Kroll reduction.

It is interesting to note that Table I infers that an appropriate voltage would produce zirconium metal from the tetrachloride without producing the insoluble (and highly pyrophoric) dichloride (as −1.807 is less than 1.864), while the higher operating voltage of this invention would apparently make a mix of metal and dichloride. Surprisingly, our invention uses a higher voltage (e.g., 2.9 volts) and still generally avoids the dichloride.

This is an all-chloride system which operates in a manner similar to a straight electrolytic cell, but, unlike the all-chloride electrolytic cells of the prior art, avoids the production of highly pyrophoric zirconium subchlorides.

This invention is not to be construed as limited to the particular examples described herein, as this is to be regarded illustrative, rather than restrictive. The invention is intended to cover all processes which do not depart from the spirit or the scope of the invention.

We claim:

1. In a method for separating hafnium from zirconium of the type wherein a feed containing zirconium and hafnium chlorides is prepared from zirconium-hafnium chloride and the feed is introduced into a distillation column, which distillation column has a reboiler connected at the bottom and a reflux condenser connected at the top and wherein a hafnium chloride enriched stream is taken from the top of the column and a zirconium enriched chloride stream is taken from the bottom of the column, wherein the improvement comprises:

reducing said zirconium enriched chloride stream taken from said distillation column to metal by electrochemically reducing an alkaline earth metal in a molten salt bath with the molten salt in said molten salt bath consisting essentially of a mixture of at least one alkali metal chloride and at least one alkaline earth metal chloride and zirconium chloride, with the reduced alkaline earth metal reacting with said zirconium chloride to produce zirconium metal and alkaline earth metal chloride.

2. The method of claim 1, wherein the molten salt in said molten salt bath consists essentially of a mixture of lithium chloride, potassium chloride, magnesium chloride and zirconium chloride.

3. The method of claim 2, wherein said bath is operated at 360°–500° C.

4. The method of claim 2, wherein a mixture of lithium chloride, potassium chloride, and magnesium chloride is a solvent in said distillation column and said zirconium enriched chloride stream taken from the bottom of the column is fed to said molten salt bath, whereby said molten salt bath acts as a stripper for the solvent of the distillation column.

* * * * *